US005403530A

United States Patent [19]

Taylor

[11] Patent Number: 5,403,530

[45] Date of Patent: Apr. 4, 1995

[54] ELONGATE MEMBER PRODUCTION METHOD

[75] Inventor: James M. Taylor, Alveston, United Kingdom

[73] Assignee: Courtaulds PLC, London, United Kingdom

[21] Appl. No.: 90,113

[22] PCT Filed: Feb. 13, 1992

[86] PCT No.: PCT/GB92/00261

§ 371 Date: Jul. 20, 1993

§ 102(e) Date: Jul. 20, 1993

[87] PCT Pub. No.: WO92/14871

PCT Pub. Date: Sep. 3, 1992

[30] Foreign Application Priority Data

Feb. 15, 1991 [GB] United Kingdom ..... 9103297

[51] Int. Cl.[6] ..... D01F 2/02

[52] U.S. Cl. ..... 264/187; 106/163.1; 106/168; 264/232; 264/233; 264/234; 536/56; 536/57

[58] Field of Search ..... 264/187, 232, 233, 234; 106/163.1, 168; 536/56, 57

[56] References Cited

U.S. PATENT DOCUMENTS

| | | | |
|---|---|---|---|
| 2,319,305 | 5/1943 | De Nooij et al. | 264/187 |
| 3,801,551 | 4/1974 | Bohme . | |
| 3,907,633 | 9/1975 | Suzuki et al. . | |
| 4,144,080 | 3/1979 | McCorsley, III | 106/186 |
| 4,246,221 | 1/1981 | McCorsely, III | 264/203 |
| 4,319,023 | 3/1982 | Aaltonen et al. | 536/57 |
| 4,416,698 | 11/1983 | McCorsely, III | 106/163.1 |

FOREIGN PATENT DOCUMENTS

| | | |
|---|---|---|
| 2407280 | 5/1979 | France . |
| 2450293 | 9/1980 | France . |
| 46-17303 | 5/1971 | Japan . |
| 61-34212 | 2/1986 | Japan . |
| 2001320 | 1/1979 | United Kingdom . |
| 2007147 | 5/1979 | United Kingdom . |
| 2043525 | 10/1980 | United Kingdom . |

OTHER PUBLICATIONS

Derwent patents database search report entitled "Fibrillation Prevention by pH Control" dated Aug. 27, 1991.

D. Loubinoux and S. Chaunis-"An Experimental Approach to Spinning New Cellulose Fibers with N-Methylmorpholine-Oxide as a Solvent"-(PCT-163) 864 Textile Research Journal 57 (1987) Feb., No. 2, Princeton, NJ USA,-pp. 61-65.

*Primary Examiner*—Leo B. Tentoni

*Attorney, Agent, or Firm*—Howson & Howson

[57] ABSTRACT

An elongate member of cellulosic material, such as fiber, having a reduced tendency to fibrillation is produced by a solvent-spinning process which includes the steps of: (i) dissolving cellulose in a solvent miscible with water to produce a dope; (ii) forcing the dope through at least one orifice to produce an elongate form; (iii) passing the elongate form through at least one water-containing bath to remove the solvent and produce the elongate member, and (iv) drying the elongate member to produce a dry elongate member, and is characterized in that the pH of each of the baths through which the elongate form and the elongate member pass during processing between production of the elongate form and the drying of the elongate member is maintained at a figure of 8.5 or less.

17 Claims, 1 Drawing Sheet

ELONGATE MEMBER PRODUCTION METHOD

BACKGROUND TO THE INVENTION

This invention relates to methods of manufacturing elongate members and has particular reference to methods of manufacturing elongate members of cellulose, further particularly but not exclusively cellulosic fibres.

Methods of producing cellulosic elongate members such as fibres and films are well known.

Cellulosic fibres are formed from polymer molecules consisting of large numbers of anhydro glucose units joined together. Some cellulose fibres are natural, such as cotton; other cellulosic fibres, such as rayon, are produced by regeneration from fibres of vegetable origin such as wood.

Viscose rayon fibre is a regenerated cellulosic fibre produced by the treatment of cellulose by caustic soda and subsequent xanthation to form sodium cellulose xanthate as an intermediate chemical compound. This compound will dissolve in caustic soda and produce a viscose dope. The viscose dope consists of the chemical compound of cellulose, i.e. the sodium cellulose xanthate, in solution in the caustic soda. After filtering, the viscose dope is extruded or spun into an acid bath to produce the fibre. In the acid bath the sodium cellulose xanthate decomposes to regenerate the cellulose.

More recently, processes have been discovered in which the cellulose can be dissolved directly in a solvent without the formation of an intermediate chemical compound. A solution of cellulose in certain solvents, for example tertiary amine-N-oxides (herein referred to as amine oxides), will produce a dope which can be spun directly into a spin bath to form by coagulation an elongate member such as a fibre by dissolving the solvent in the water of the spin bath and recrystallising or precipitating the cellulose. This type of process is referred to herein as "solvent spinning".

After the spinning step in solvent spinning, the fibre is passed through a series of water baths to remove the residual amine oxide still in the cellulose and through bleach and wash baths to produce a cellulosic fibre from which the amine oxide has been removed virtually completely. After the wash baths, the fibre is dried in a conventional drying oven to produce a tow for subsequent processing.

The direct production of cellulosic elongate members, such as fibres, using solvent spinning rather than viscose production has some commercial advantages over the viscose route in that there is much less chemical usage and the equipment required is simpler. However, it has been found that cellulose fibre produced by such a direct solvent-spinning route does have properties different from regenerated cellulose fibre produced by the viscose production process. In particular, it has been found that solvent-spun cellulosic fibre suffers from fibrillation when wet-abraded.

Fibrillation comprises the partial breaking up of the fibre in a longitudinal direction with the formation of small hairs on the fibre. These hairs tend to twist and give the fibre, when looked at under the microscope, a hairy appearance. These hairs, or fibrils, on the fibre give rise to two significant problems; the first problem is the appearance of the fabric and the second problem is the tendency of the fabric to form pills on its surface.

The fibres can be dyed loose, or fabrics woven from undyed material can be dyed in one of two ways. The fabric can either be open-width dyed, which means that the material is dyed on a continuous basis, or the fabric can be rope dyed, which means that the fabric is dyed in a batchwise exhaust-dyeing process.

Each process has its own advantages and disadvantages. Many fabrics are dyed by rope dyeing, which means that small quantities of the fabric can be dyed, and there is less wastage and down-time in the process. Essentially, the fabric is contracted into a rope and then passed into a vat for dyeing purposes. It has been found that, if a fabric is woven or knitted from a solvent-spun cellulosic fibre produced from the direct dissolution of the cellulose in the solvent, then fibrillation occurs during the rope-dyeing process. After dyeing, the fabric has a white-looking surface, a fibrillated or frosted finish which is unacceptable in many cases, particularly if the fabric is dyed to a dark colour, such as dark navy or black, when the fibrils show up as a light white frosting on a dark background. Further washing of the fabric after use can then make the fibrillation effect worse until the garment made from the fabric is visually unacceptable, although physically quite useable.

Although it is possible to open-width dye woven fabrics, it is often not practical to open-width dye knitted fabrics because of the need for relaxation during the dyeing process. Dyeing in the open-width process tends to give a tenser, harsher fabric than rope dyeing.

As is mentioned above, material which has fibrillated during the dyeing process tends to fibrillate further during washing processes, and after repeated washing the fibrils ball up and pill. Because cellulosic fibres formed from solvent systems are inherently strong, the pills are held onto the fibres and do not fall off the fabric. Again this can reduce the attractiveness of fabrics and garments made from fibrillated fibres.

There is therefore a need to produce a way of reducing the tendency to fibrillation in solvent-spun cellulose fabrics produced from a cellulose dope made by the direct dissolution of cellulose in a solvent.

DISCLOSURE OF THE INVENTION

It has now unexpectedly been discovered that, by strict control of the pH of the wash bath(s) used in the production of the elongate members of cellulose produced by solvent-spinning methods, it is possible significantly to affect the properties of the solvent-spun elongate members, particularly the tendency of solvent-spun fibre to fibrillate at much later processing stages.

The present invention provides a method of manufacturing a solvent-spun cellulosic elongate member including the steps of:

(i) dissolving cellulose in a solvent miscible with water to produce a dope, (ii) forcing the dope through at least one orifice to produce an elongate form, (iii) passing the elongate form through at least one water-containing bath, preferably a plurality of such baths, to remove the solvent and produce the elongate member, and (iv) drying the elongate member to produce a dry cellulosic elongate member, characterised in that the pH of the bath or each of the baths through which the elongate form and the elongate member pass during the processing between the production of the elongate form and the drying of the elongate member is maintained at a figure of 8.5 or less.

The elongate member may be a fibre or a film or a tube.

The elongate member may be treated with water at a pH of 7 or less and, prior to drying, the elongate member is not exposed to aqueous solutions having a pH greater than 8.5.

Preferably the solvent for the cellulose is a water-compatible amine oxide. Typical of the amine oxides which will dissolve cellulose and are soluble in water are N,N-dimethyl-cyclohexylamine-N-oxide, N,N-dimethylethanolamine-N-oxide, N-methylmorpholine-N-oxide, and N,N-dimethylbenzylamine-N-oxide. The dope may further include water.

Preferably, the dope passes into a water-containing spin bath from which the solvent is recovered for recycling and then into a plurality of water-containing wash baths. Further preferably, the pH of the water-containing bath(s), especially the wash bath(s), is maintained at a figure of greater than 3, preferably greater than 4 or greater than 4.5 or greater than 5, and less than 6.5. Further preferably the pH is maintained at less than 6.0 and even further preferably it is maintained at less than 5.5 or between 5 and 6.

Optionally, the fibre may be bleached, after drying, in a bleach bath to produce a bleached fibre.

A suitable acid for maintaining the pH of the bath(s) below 7 is formic acid, acetic acid, hydrochloric acid or sulphuric acid.

DESCRIPTION OF DRAWINGS

By way of example, embodiments of the present invention will now be described with reference to the accompanying drawings, of which.

MODES OF CARRYING OUT THE INVENTION

Cellulose in the form of wood pulp may be dissolved in amine oxide in any suitable manner such as is described in U.S. Pat. No. 4,144,080 or in UK Patent Specification 2,007,147, the contents of both of which are incorporated herein by way of reference. The resulting solution typically contains 23.8% by weight of cellulose in amine oxide and typically has added to it 10.5% by weight of water to form a suitable dope for spinning.

The dope may be spun, i.e. extruded, in any suitable known manner such as by spinning into a water-containing spin bath, for example by spinning with an air gap as is described in U.S. Pat. No. 4,246,221, the contents of which are incorporated herein by way of reference, to produce an elongate form consisting essentially of a gel of cellulose in amine oxide. The shape of the elongate member will be principally determined by the shape of the hole through which the dope is spun. If the hole is a slit a film will be formed, if it is an annulus a tube will be formed and if it is circular or near circular a circular or near circular fibre will be formed. The gel coagulates, and the amine oxide diffuses out of the coagulating elongate form so that the dissolved cellulose reforms into the elongate member.

More than one fibre may be produced by using a spinnerette with a plurality of holes.

Hereafter the invention will be discussed only in relation to fibres or filaments as examples of the elongate form and member, without thereby intending to restrict the elongate form or member in this way.

The next stage in the production of a useable fibre is to pass the amine-oxide-loaded cellulose fibre or filament from the spin bath through a series of water-containing wash baths to remove the residual amine oxide.

Figure 1:
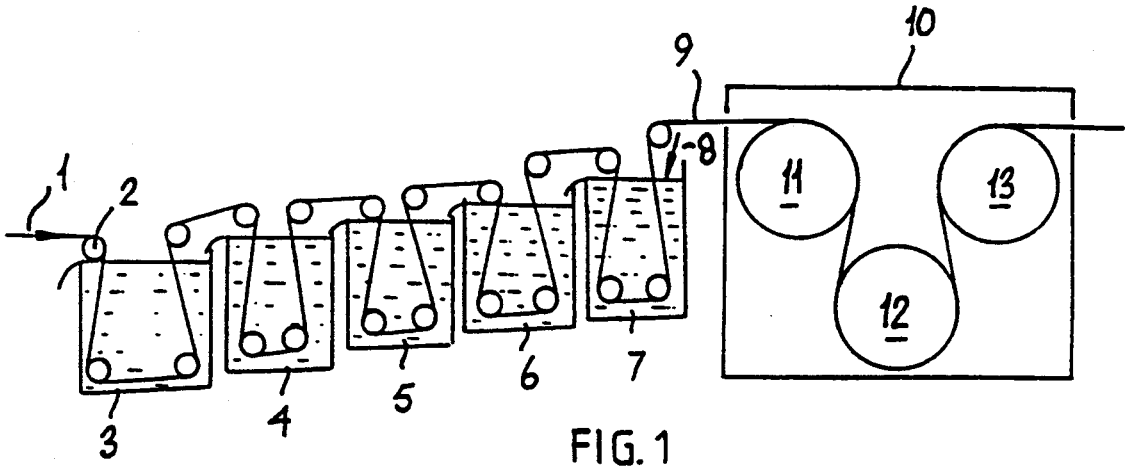
FIG. 1 is a schematic cross-section of part of a cellulosic fibre production line.

Referring to FIG. 1 of the accompanying drawings, this shows a fibre 1 still containing residual amine oxide entering into the wash line from the spinnerette and initial spin bath system. Normally the fibre 1 will be formed of a series of individual filaments; many hundreds or thousands of filaments or strands may form the fibre 1. The fibre then passes round a series of rollers such as roller 2 into a plurality of water-containing wash baths such as wash baths 3, 4, 5, 6 and 7.

In countercurrent with the fibre 1, water is passed through the baths, cascading from bath 7 into bath 6 and so on, and washes out the amine oxide as the fibre passes through the wash line. Fresh demineralised water is added to bath 7 as shown by arrow 8.

At the end of the line, therefore, there emerges a fibre 9 which is substantially free of amine oxide but which is wet with water.

The fibre then enters a drying oven 10, essentially comprising a series of heated rollers 11, 12, 13 through which hot air is passed to dry the fibre in a conventional manner.

The production line illustrated schematically in the drawing is a standard production line in terms of its physical structure. Optional elements may be incorporated, such as hot stretching or steam stretching, as required.

If conventional viscose manufacturing practice were to be followed, one of the baths 3 to 7 encountered by the fibre 1 would be a bleach bath, the function of which is to bleach out the coloured impurities from the fibre. Conventionally, an alkaline bleach bath is used to bleach the fibre; typically, sodium hypochlorite is used in the alkaline bath, having a pH of about 10 to 11 to bleach the fibre, before subsequent washing steps further down the demineralised water line.

It has now unexpectedly been found that if the fibre is not contacted with an alkali of greater than pH 8.5 before it is dried in the drying oven 10 then the tendency of the fibre to fibrillate in later wet processing after it has been dried is very significantly reduced.

Typically, the pH of the spin bath, in which the bulk of the amine oxide is removed, is 8.5. In this bath the dope is converted to a cellulosic fibre. The pH of the baths in the washing line then gradually decreases from about pH 8.5 until it reaches a pH of approximately 5.5 in the final bath 7 where demineralised water is fed into the wash line. The reason the pH of the demineralised water is about 5.5 rather than 7 is that it is normally not the case that carbon dioxide is removed from the demineralised water used as the feed, and the carbon dioxide in the water makes it slightly acidic.

It has unexpectedly been found that if the alkaline bleach given to the fibre is omitted prior to the drying of the fibre, subsequent alkaline wet treatment of that previously dried fibre (even at a pH greater than 8.5 as can occur in bleach baths) does not have the same effect in terms of producing fibrils in the fibre in later wet mechanical processing as it would have done on the fibre not treated in accordance with the invention.

It should be noted that with cellulose fibre not in accordance with the invention, which has been produced by dissolving cellulose in amine oxide, spinning and bleaching using alkaline bleaches of pH greater than 8.5 on the never-dried fibre, the fibre emerging from the drying line is not fibrillated at that stage. Furthermore, such fibre not in accordance with the invention does not fibrillate if treated only in the dry, even if subjected to considerable mechanical work and abrasion. Typically, the fibre would be passed to a crimper and cut to form staple material. The staple material would then be carded and formed into a sliver for spinning into yarn. The yarn could then be knitted or woven in the dry without producing any significant fibrillation of the fibre. It is only after the resulting yarn of cellulosic material not in accordance with the invention and in fibre form is mechanically treated in the wet that fibrillation occurs. It is for this reason that exhaust or rope dyeing of the fibre was impossible hitherto without producing significant fibrillation of the fibre.

With fibre treated in accordance with the invention, mechanical treatment in the dry likewise has no effect on fibrillation, but it has however been found that with subsequent mechanical processing in the wet there is a significantly reduced tendency for fibrils to form on the fibre.

It is possible, therefore, to use fibres produced in accordance with the invention either for weaving or knitting and subsequently to rope-dye or exhaust-dye the materials in a batchwise process without producing significant quantities of fibril.

To evaluate the exact pH which will produce the effect of the present invention a series of standards was first prepared to produce a so-called Fibrillation Index.

To measure fibrillation and to fix a scale so that changes in fibrillation could be determined, a series of fibres having nil and increasing amounts of fibrillation was identified. A standard length of fibre was then measured and the number of fibrils (fine hairy spurs extending from the main body of the fibre) along the standard length was counted. The length of each fibril was measured microscopically, and an arbitrary number, being the product of the number of fibrils multiplied by the average length of each fibril, was determined for each fibre.

The fibre having the highest number for the product was then identified as the most fibrillated fibre and was assigned the arbitrary Fibrillation Index Number of 10. The wholly unfibrillated fibre was assigned a Fibrillation Index Number of zero, and the remaining fibres were ranged from 1 to 10 based on the arbitrary numbers determined for them.

The measured fibres were then used to form an optical scale. To determine the Fibrillation Index Number for any other set of fibres, each fibre of a sample of five or ten fibres was visually compared under the microscope with a set of graded fibres and an index number determined. The visually determined index numbers were then averaged to give a Fibrillation Index Number for the sample having received a given treatment. It will be appreciated that visual determination and averaging is many times quicker than measurement, and it has been found that skilled fibre technologists are consistent in their rating of the fibres.

As yet there is no internationally agreed standard for fibrillation and therefore the fibrillation standard generated by the applicants is a somewhat arbitrary standard but has the advantage of enabling quantitative comparison between fibres to take place.

A series of tests was carried out with fibre in which the pH of the first wash bath 3 (FIG. 1) seen by the fibre after the spin bath was varied between 3 and 8. The spin bath has a pH of about 8.5. It cannot easily be varied without interfering with the amine oxide recovery system. The demineralised water fed into the bath 7 at point 8 had a pH of 6.5. After washing and drying, the dried fibre was given the following scouring, bleaching and dyeing treatment:

1 g of fibre was placed in a stainless steel dyeing tube in a Roaches bath. To the bath was added an aqueous scouring solution comprising:

2 g/l anionic detergent (Detergyl)

2 g/l sodium carbonate and the solution was heated to 95° C. and maintained at that temperature for 60 minutes. The scouring solution was then poured out of the bath, and the fibre, still in the dyeing tube, was rinsed first in hot tap-water then in cold tap-water.

Subsequently, the fibre in the tube was bleached in an aqueous solution comprising:

15 ml/l $H_2O_2$ 2 g/l stabiliser (Prestogen PC)

1 g/l NaOH and the bleaching was carried out for 90 minutes at 95° C.

Again the sample, still in the dyeing tube, was rinsed first in hot tap-water then in cold tap-water.

The fibre was then dyed using an aqueous dye solution comprising:

8% by weight Procion Navy HER-150

55 g/l $Na_2SO_4$ 20 g/l $Na_2CO_3$.

The fibre was dyed at 80° C. for 60 minutes. Whilst still in the dyeing tube the fibre was washed to remove loose dye using a 2 ml/l aqueous solution of Sandopur SR for 20 minutes at 100° C.

The fibre was then rinsed in cold water and air-dried at 90° C. Small samples of the fibre treated at different pH's were then visually examined to determine the Fibrillation Index.

Figure 2:
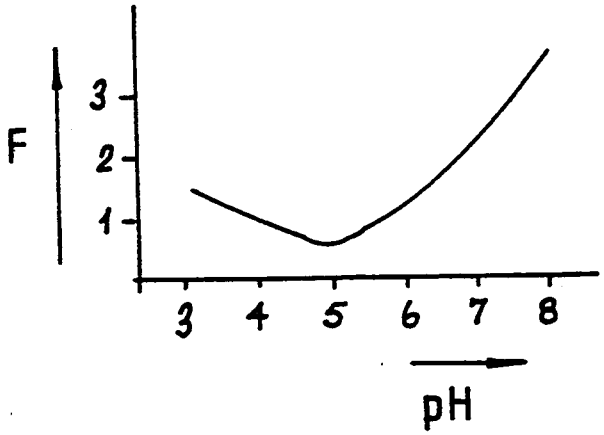
FIG. 2 is a graph of Fibrillation Index Number (F) against pH.

The effect on the Fibrillation Index Number is shown in FIG. 2 of the accompanying drawings. It can be seen that as the pH varies between 4 and 6 the fibrillation effect of the fibre is very low; however as the pH increases above 6 the Fibrillation Index Number significantly increases. Typically, the acid used to maintain the fibre at a pH below 6.5 in the first bath is a buffered acetic acid such as the acid "Sandacid BS" available from Sandoz.

Further tests were carried out to investigate the effects of treatment at even higher pH before first drying. Samples of never-dried solvent-spun cellulose fibre were taken from the spin bath and immersed in solutions of differing pH, from 4.0 to 12.5, to remove residual amounts of amine oxide. They were then dried at 100° C. at that pH and without water washing. After drying, the following Fibrillation Index Numbers were obtained:

| pH | Fibrillation Index Number |
|---|---|
| 4.0 | 1.8 |
| 7.0 | 2.6 |
| 9.0 | 3.4 |
| 11.0 | 3.6 |
| 12.5 | 6.0 |

The new treatment therefore produces an elongate member, particularly fibre, having enhanced resistance to fibrillation without any significant effect on extensibility or tenacity. It is cheap to use in that it omits the alkaline treatment of the fibre and therefore reduces the length of the treatment line required for the production of the fibre. The omission of the bleaching stage removes the need for hyprochlorite usage which is an environmentally useful step to take. The unbleached fibre has a slightly yellower look than bleached fibre but is quite acceptable as a dyeing-base colour; its whiteness is comparable to that of bleached cotton. The fact that the fibre which has been dried without having been exposed to a pH of greater than 8.5 can subsequently be bleached at high pH's, say 10 to 13, without exhibiting high fibrillation tendencies is very surprising, given that the same treatment prior to drying would result in a fibre very susceptible to fibrillation.

The same treatment can be given to films or tubes of solvent-spun cellulose.

It is claimed:

1. A method of manufacturing a solvent-spun cellulosic elongate member including the steps in sequential order of:

(a) dissolving cellulose in a solvent miscible with water to form a dope;

(b) forcing said dope through at least one orifice to produce an elongate form;

(c) passing said elongate form through at least one water-containing bath to remove said solvent from said elongate form, thereby producing said elongate member;

(d) drying said elongate member to produce a dried elongate member;

(e) bleaching said dried elongate member in a bleach bath having a pH greater than 8.5 to produce a bleached elongate member; and (f) drying said bleached elongate member;

wherein the pH of each water-containing bath through which the elongate form is passed between said forcing step (b) and said drying step (d) is maintained at 8.5 or less.

2. A method of manufacturing a solvent-spun cellulosic elongate member including the steps in sequential order of:

(a) dissolving cellulose in a solvent miscible with water to form a dope;

(b) forcing said dope through at least one orifice into a water-containing spin bath to produce an elongate form;

(c) passing said elongate form through at least one water-containing bath to remove said solvent from said elongate form, thereby producing said elongate member; and (d) drying said elongate member to produce a dried elongate member;

wherein the pH of each water-containing bath through which the elongate form is passed between the forcing step (b) and the drying step (d) is maintained at 8.5 or less by addition of an acid to at least one such water-containing bath.

3. A method as claimed in claim 1, in which the solvent is a water-compatible amine oxide.

4. A method as claimed in claim 3, in which the amine oxide is selected from the group consisting of N,N-dimethyl cyclohexylamine-N-oxide, N,N-dimethylethanolamine-N-oxide, N-methylmorpholine-N-oxide and N,N-dimethylbenzylamine-N-oxide.

5. A method as claimed in claim 4, in which the dope further includes water.

6. A method as claimed in claim 1, in which the elongate member is passed through a plurality of countercurrent wash baths.

7. A method as claimed in claim 1, in which the dope passes first into a water-containing bath from which the solvent is recovered for recycling, and then into a plurality of water-containing wash baths.

8. A method as claimed in claim 7, in which the pH of the first wash bath is maintained in the range 4 to 6.

9. A method as claimed in claim 2, in which, after drying, the dry elongate member is bleached in a bleach bath having a pH greater than 8.5.

10. A method as claimed in claim 1, in which the elongate member is a fibre.

11. A method as claimed in claim 2 in which the solvent is a water-compatible amine oxide.

12. A method as claimed in claim 2, in which the amine oxide is selected from the group consisting of N,N-dimethyl cyclohexylamine-N-oxide, N,N-dimethylethanolamine-N-oxide, N-methylmorpholine-N-oxide and N,N-dimethylbenzylamine-N-oxide.

13. A method as claimed in claim 12 in which the dope further includes water.

14. A method as claimed in claim 2, in which the elongate member is passed through a plurality of contercurrent wash baths.

15. A method as claimed in claim 2, in which the dope passes first into a water-containing bath from which the solvent is recovered for recycling, and then into a plurality of water-containing wash baths.

16. A method as claimed in claim 15 in which the pH of the first wash bath is maintained in the range of 4 to 6.

17. A method as claimed in claim 2, in which the elongate member is a fibre.

* * * * *